US009913539B2

(12) United States Patent
Potrykus et al.

(10) Patent No.: US 9,913,539 B2
(45) Date of Patent: Mar. 13, 2018

(54) OFFICE CHAIR

(71) Applicant: Haworth, Inc., Holland, MI (US)

(72) Inventors: Martin W. Potrykus, Bamberg (DE); Peter T. LaDuke, Holland, MI (US); Jason W. Hall, Holland, MI (US); Timothy J. Scholma, Hillsborough, NJ (US); Nicolai Czumaj-Bront, Berlin (DE); Teresa A. Bellingar, Holland, MI (US); Michael W. Welsh, Rockford, MI (US); Larry A. Wilkerson, Comstock Park, MI (US); Kyle R. Fleet, Byron Center, MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 14/777,039

(22) PCT Filed: Mar. 14, 2014

(86) PCT No.: PCT/US2014/028161

§ 371 (c)(1),
(2) Date: Sep. 15, 2015

(87) PCT Pub. No.: WO2014/143958

PCT Pub. Date: Sep. 18, 2014

(65) Prior Publication Data

US 2016/0029801 A1 Feb. 4, 2016

Related U.S. Application Data

(60) Provisional application No. 61/790,582, filed on Mar. 15, 2013.

(51) Int. Cl.
*A47C 7/44* (2006.01)
*A47C 31/02* (2006.01)
(Continued)

(52) U.S. Cl.
CPC ..... *A47C 7/44* (2013.01); *A47C 7/40* (2013.01); *A47C 7/445* (2013.01); *A47C 7/46* (2013.01); *A47C 31/023* (2013.01)

(58) Field of Classification Search
CPC .... A47C 7/44; A47C 7/46; A47C 7/40; A47C 7/445; A47C 31/023
See application file for complete search history.

(56) References Cited

U.S. PATENT DOCUMENTS 3,353,869 A 11/1967 Getz et al.
3,476,169 A 11/1969 Militano
(Continued)

FOREIGN PATENT DOCUMENTS

CN 2168479 6/1994
CN 1331940 1/2002
(Continued)

OTHER PUBLICATIONS

International Search Report and Written Opinion dated Jul. 29, 2014, International Application No. PCT/US2014/028161.

*Primary Examiner* — Beth A Stephan
(74) *Attorney, Agent, or Firm* — Warner Norcross & Judd LLP

(57) ABSTRACT

A back support for a chair includes a chair frame, a pair of upright support posts mounted to the chair frame, the upright support posts being laterally flexible with respect to the chair frame, a plurality of flexible support arms extending laterally outwardly from the upright support posts, the support arms each including a peripheral edge, the support arms including a first set of support arms extending in a first lateral direction from the upright posts and a second set of support arms extending in a second direction from the upright posts; and a material extending in tension between the peripheral edges of the first set of support arms and the peripheral edges of the second set of support arms such that
(Continued)

at least a central portion of the material is spaced from the support arms. In addition, a seat support includes a repositionable front edge.

12 Claims, 18 Drawing Sheets

(51) Int. Cl.
*A47C 7/40* (2006.01)
*A47C 7/46* (2006.01)

(56) References Cited

U.S. PATENT DOCUMENTS

| | | | | |
|---|---|---|---|---|
| 4,049,315 | A | 9/1977 | Jacobson | |
| 4,408,800 | A | 10/1983 | Knapp | |
| 4,556,254 | A | 12/1985 | Roberts | |
| 4,658,807 | A | 4/1987 | Swain | |
| 4,744,603 | A | 5/1988 | Knoblock | |
| 5,320,410 | A | 6/1994 | Faiks et al. | |
| 5,403,067 | A | 4/1995 | Rajaratnam | |
| 5,586,808 | A | 12/1996 | Oelke | |
| 5,645,321 | A | 7/1997 | Seroldi | |
| 5,826,937 | A | 10/1998 | Massara | |
| 5,951,109 | A | 9/1999 | Roslund et al. | |
| 5,988,757 | A | 11/1999 | Vishey et al. | |
| 6,572,190 | B2 * | 6/2003 | Koepke | A47C 1/03255 297/284.1 |
| 6,910,736 | B2 | 6/2005 | White | |
| 6,971,717 | B1 | 12/2005 | Rhodes | |
| 7,032,971 | B2 | 4/2006 | Williams | |
| 7,396,438 | B2 | 7/2008 | Stobie | |
| 7,909,402 | B2 | 3/2011 | Chu et al. | |
| 8,622,472 | B2 | 1/2014 | Rajaratnam | |
| 2001/0008955 | A1 | 7/2001 | Garth | |
| 2002/0130540 | A1 | 9/2002 | Rajasingham | |
| 2002/0190552 | A1 | 12/2002 | Koepke et al. | |
| 2004/0007910 | A1 | 1/2004 | Skelly | |
| 2004/0104610 | A1 | 6/2004 | Jaskot et al. | |
| 2004/0256899 | A1 | 12/2004 | Moore et al. | |
| 2005/0179292 | A1 | 8/2005 | Knoblock et al. | |
| 2006/0103214 | A1 | 5/2006 | Andersson et al. | |
| 2006/0181126 | A1 | 8/2006 | Eysing | |
| 2006/0255635 | A1 * | 11/2006 | Iijima | A47C 7/405 297/284.3 |
| 2007/0102987 | A1 | 5/2007 | Chen | |
| 2008/0296945 | A1 | 12/2008 | Bedford et al. | |
| 2009/0085388 | A1 | 4/2009 | Parker et al. | |
| 2009/0102268 | A1 | 4/2009 | Schmitz et al. | |
| 2009/0261644 | A1 | 10/2009 | Piretti | |
| 2010/0187882 | A1 | 7/2010 | Chen | |
| 2012/0061988 | A1 | 3/2012 | Jaranson et al. | |
| 2012/0299350 | A1 | 11/2012 | Willingham | |
| 2013/0221724 | A1 * | 8/2013 | Fowler | A47C 31/126 297/452.1 |
| 2014/0062154 | A1 | 3/2014 | Minino et al. | |
| 2014/0117738 | A1 | 5/2014 | Takahashi et al. | |
| 2014/0183914 | A1 | 7/2014 | Cvek | |

FOREIGN PATENT DOCUMENTS

| | | | |
|---|---|---|---|
| CN | 1470420 | 1/2004 | |
| CN | 1564666 | 1/2005 | |
| CN | 1575142 | 2/2005 | |
| CN | 101715310 | 5/2010 | |
| DE | 102007002284 | 7/2008 | |
| DE | 102008009509 | 8/2009 | |
| DE | 102011100708 | 11/2012 | |
| EP | 1232703 | 8/2002 | |
| EP | 1693248 | 8/2006 | |
| EP | 1785070 | 5/2007 | |
| EP | 1911374 | 4/2008 | |
| EP | 1946676 | 7/2008 | |
| WO | 9212654 | 8/1992 | |
| WO | 9848670 | 11/1998 | |
| WO | 9848671 | 11/1998 | |
| WO | 0022961 | 4/2000 | |
| WO | 03063651 | 8/2003 | |
| WO | 2010120139 | 10/2010 | |
| WO | 20120167940 | 12/2012 | |
| WO | WO 2012167940 A1 * | 12/2012 | A47C 1/03255 |

* cited by examiner

OFFICE CHAIR

BACKGROUND OF THE INVENTION

The present invention is directed to office chairs, and, more particularly, to mechanisms for providing flexibility and adjustability to portions of an office chair.

The market for office seating continues to demand more than just a place to sit. Today's users want comfort, function, and a high degree of adjustability, all in an aesthetically pleasing configuration. More recently, it is known for office chairs to have a back support structure that includes a flexible material, such as a woven mesh fabric, attached in tension to a peripheral frame. These arrangements can provide a high degree of comfort, even over extended periods. They are, however, typically limited by the rigidity of the peripheral frames. These frames must generally be rigid in order to support the mesh fabric in tension, and the rigidity places limits on the flexibility of the back support. In some cases, user's may seek a degree of lateral flexibility in the back support for added comfort and a great range of movement whilst seated in the office chair.

In order to adapt office chairs for users of different sizes, it is also know to provide mechanisms for adjusting the depth of the seat surface, between the front edge of the seat and the back support. This distance can greatly impact the location at which the user feels pressure underneath the thighs, and thus impact the comfort level of the seat as a whole. Difficulties can arise in the implementation of such mechanisms, for instance, in that extension or contraction of the seat front edge can results in unwanted stretched or excess fabric.

SUMMARY OF THE INVENTION

The present invention provides a back support for a chair including a chair frame, a pair of upright support posts mounted to the chair frame, the upright support posts being laterally flexible with respect to the chair frame, a plurality of flexible support arms extending laterally outwardly from the upright support posts, the support arms each including a peripheral edge, the support arms including a first set of support arms extending in a first lateral direction from the upright posts and a second set of support arms extending in a second direction from the upright posts; and a material extending in tension between the peripheral edges of the first set of support arms and the peripheral edges of the second set of support arms such that at least a central portion of the material is spaced from the support arms In one embodiment, each of the peripheral edges includes an attachment portion having structure for attaching the support arm to the material, the attachment portion including a face, the structure extending from the face, wherein the face is positioned at an angle with respect to the support arm. The support arms and the upright support posts may be formed integrally from the same material. The support arms may be curved to have a convex shape to conform to the shape of a user's back.

In one embodiment, the back support includes a lumbar support mechanism having a first portion mounted between the upright support posts and a lumbar pad extending from the first portion to face the back of a user sitting in the chair.

In another embodiment, the present invention includes a seat support with a repositionable front edge including a fixed base, a seat mounted on the fixed base, the seat having a front portion and a rear portion, the rear portion mounted to the base such that it is fixed with respect to the base, the front portion, including the front edge, being movable with respect to the rear portion; and a cover extending over the seat front portion and the seat rear portion, the cover attached to the seat front portion and the seat rear portion, the cover movable with the seat front portion such that a portion of the cover including the front edge cover curls at least partially underneath the seat front portion when the seat front portion is moved in a first direction, and the portion of the cover extends away from the seat rear portion when the seat front portion is moved in a second direction.

DESCRIPTION OF THE CURRENT EMBODIMENTS

An office chair according to the current embodiments of the present invention is shown in FIGS. 1-30 and generally designated 10. In particular, the embodiments of the office chair 10 disclosed in the present application include a back support structure 12 for comfortably supporting the back of a user, and an efficient method of manufacturing such a back support, as well as a mechanism for repositioning the front edge of a seat support 14.

Figure 1A:
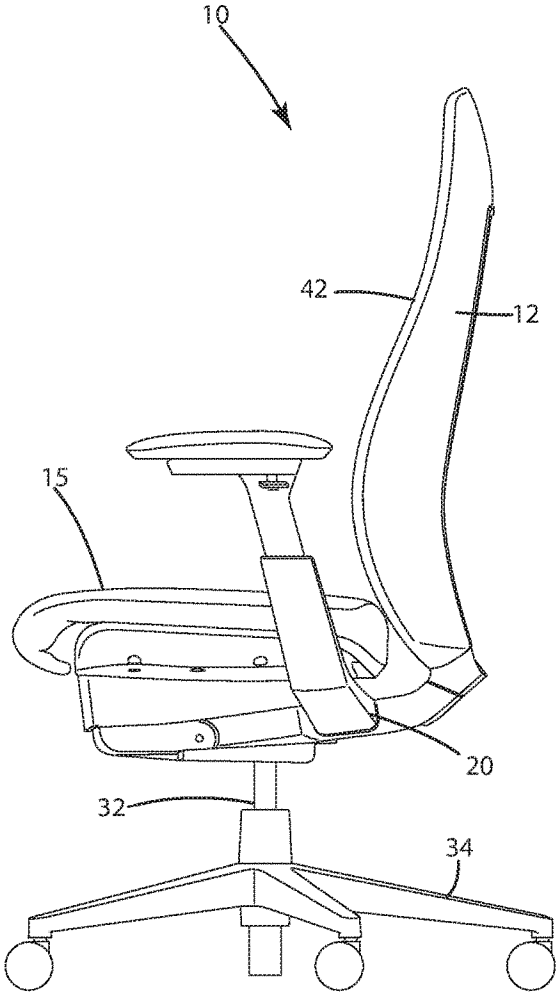
FIG. 1A is a side view thereof.
Figure 1:
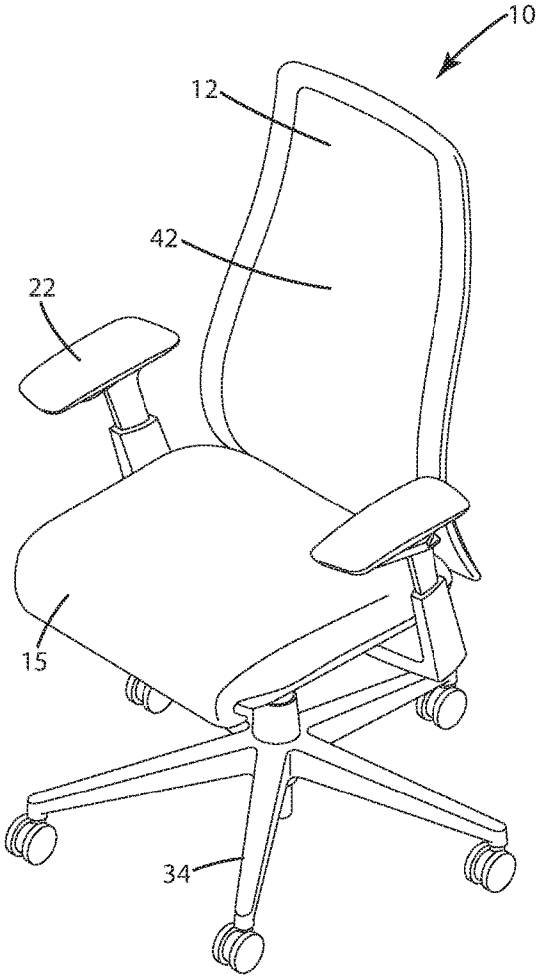
FIG. 1 is a perspective view of an office chair according to one embodiment of the present invention.

FIGS. 1-27 are directed to an aspect of the office chair 10 including a back support structure 12 including a pair of generally vertical support posts 18, and a plurality of support arms 21 extending outwardly from the support posts 18. FIGS. 1 and 1A show views of a completed version of the chair 10. The chair generally includes a chair frame 20, a back support structure 12, a seat support 15, and an armrest assembly 22 extending from the chair frame 20. The chair frame 20 may include an upright support member 19 and a plurality of outwardly extending legs 28. In one embodiment, a cover 42, which may be formed from a fabric material, may extend over portions of the back support 12. The cover 42 may include a cushion, such as a foam cushion (not shown) or may form a cover for a cushion.

Figure 3:
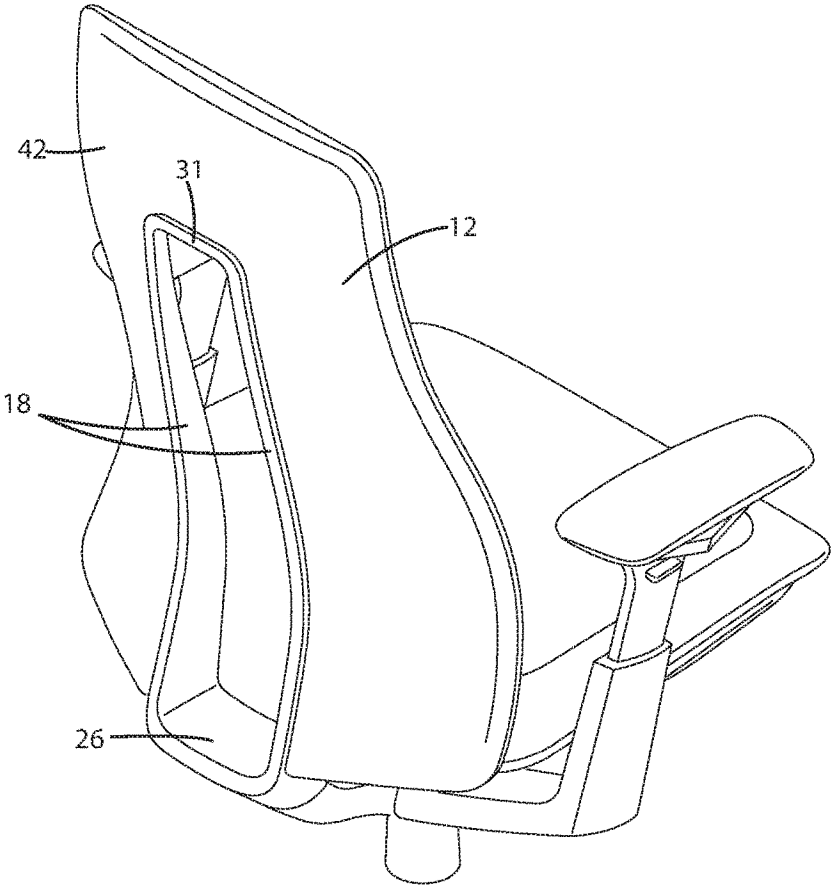
FIG. 3 is a rear perspective view thereof with a portion of the fabric removed.
Figure 2:
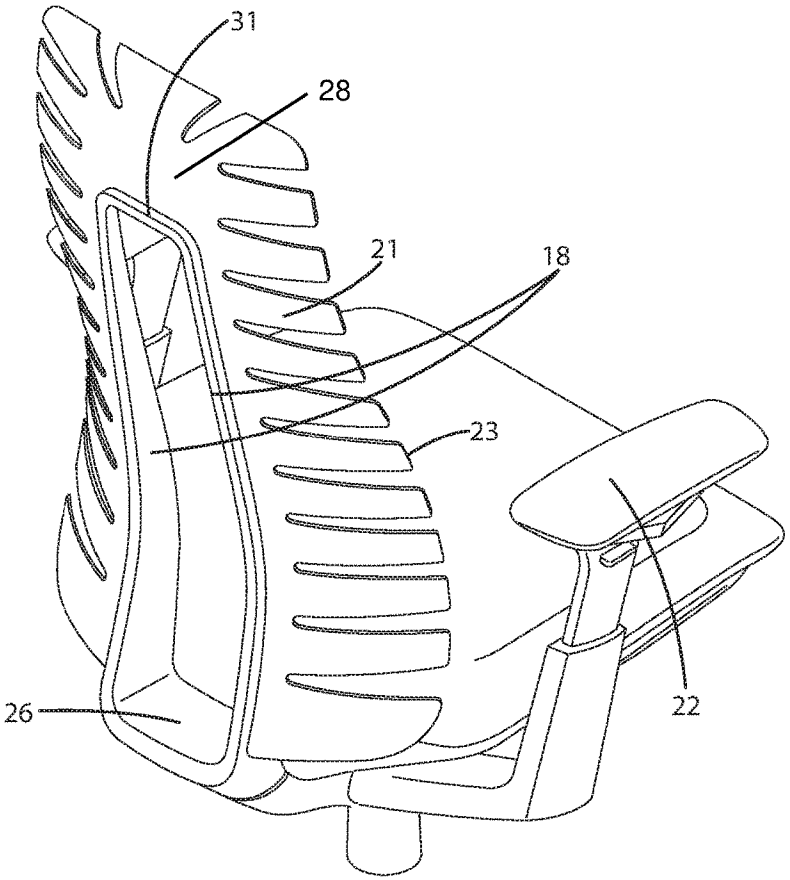
FIG. 2 is a rear perspective view of a portion of an office chair according to one embodiment.
Figure 4:
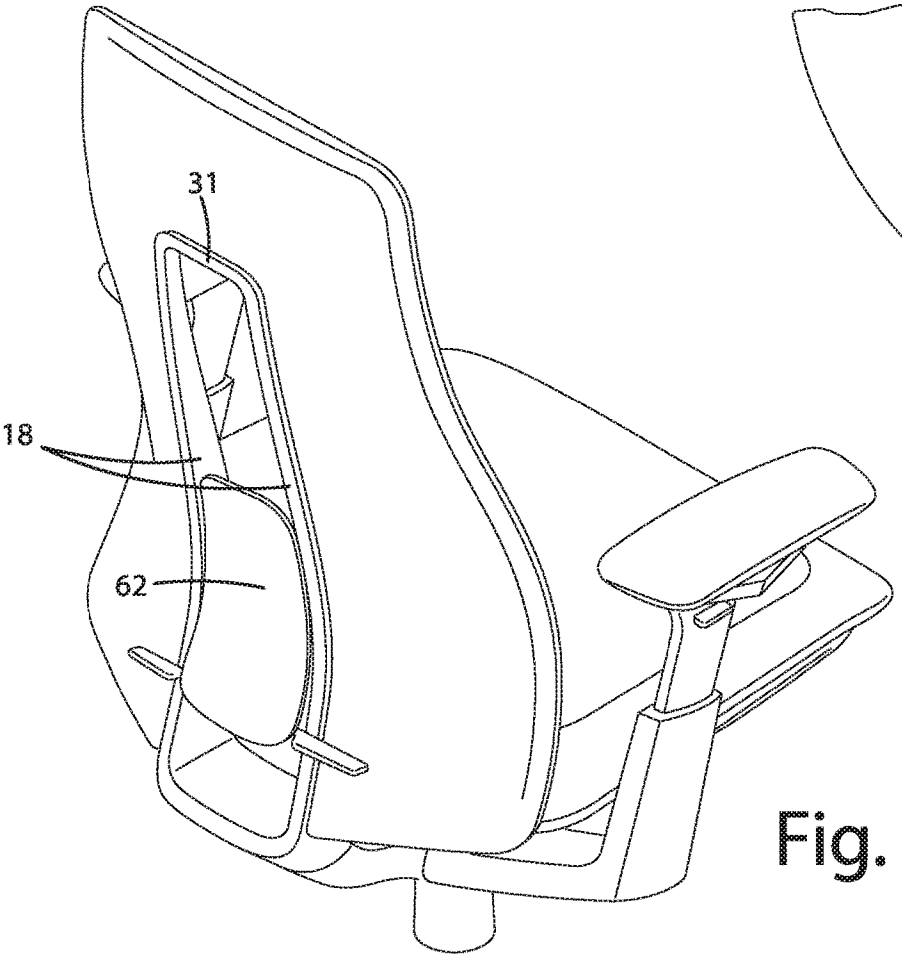
FIG. 4 is a rear perspective view of a portion of an office chair including a lumbar support.

FIGS. 2-4 show rear views of the back support structure 12. As shown, the back support 12 generally includes a pair of upright posts 18, which are connected by a generally horizontal lower cross member 26 attached to the chair frame 20, and a generally horizontal upper cross member 31. The support posts 18 may extend generally parallel to one another, or may slightly converge or diverge as they approach an upper edge of the chair 10. The support posts 18 may be formed from a variety of materials, such as steel (or another metal, or plastic, such as an injection molded plastic. As described in more detail below, the support posts 18 and the support arms 21 extending from the support posts 18 may be formed integrally from a single piece of molded plastic. The support posts 18 provide support for the back support structure 12, but also may provide a degree of lateral flexibility for the back support 12. For example, the support posts 18 may have a degree of resiliency such that they are capable of bending slightly from side-to-side under the force of a user's back, which enables the back support 12 to move with the user as the user shifts back and forth.

FIG. 3 shows a rear view of the office chair 10 with a rear portion of the fabric cover 42 removed to expose the support arms 21 extending from the support posts 18. Throughout the illustrated embodiments, the support arms 21 extend outwardly from the support posts 18 in a direction generally perpendicular to the support posts 18, although they may otherwise extend at a different angle from the support posts 18. Each support arm 21 includes a peripheral edge 23. More particularly, in the embodiment shown in FIG. 3, a series of spaced apart support arms 21 extend outwardly from each one of the support posts 18. Each support arm 21 may be shaped as desired, depending on the desired support characteristics. Longer, narrower arms are more flexible, and provide more of a free floating feel for the back support, whereas thicker, shorter arms are more rigid. In the illustrated embodiment, the width of each support arm 21 gradually converges approaching the distal edge 23. As shown in FIG. 3, a plate 28 extends from the upper cross member 31, and a plurality of support arms extend outwardly from the plate 28. The support arms 21 may be curved into a convex shape to envelop a portion of the user's back and provide comfort and support, and may be provided with a degree of resiliency such that each individual support arm is capable of flexing upon receiving a force from the user. The support arms 21 each define a lateral length extending generally from the upright posts 18, whereby each individual support arm 21 can flex independently of the other support arms 21.

Figure 5:
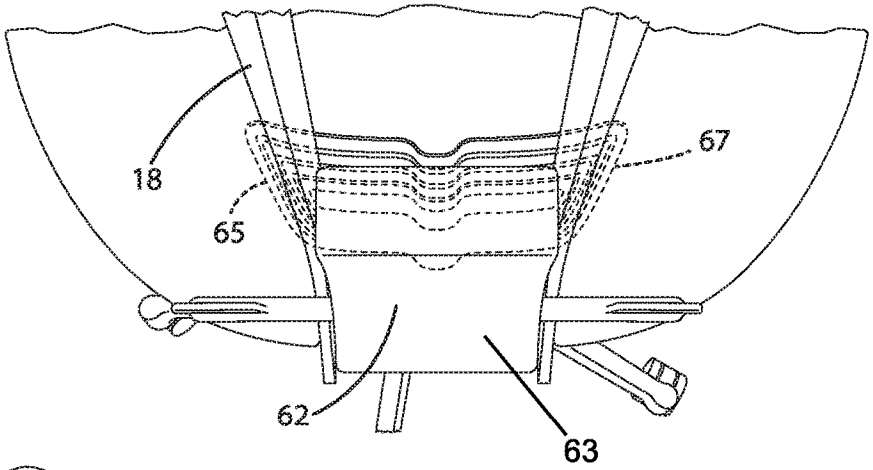
FIG. 5 is a portion of an office chair including a lumbar support.

FIG. 4 and FIG. 5 show a version of the chair including an optional lumbar support mechanism 62 fitted between the upright support posts 18. In one embodiment, the lumbar support 62 may be vertically adjustable by sliding the lumbar support up and down between the upright posts 18. A variety of lumbar support mechanisms may be used; however, the illustrated embodiment includes a lumbar support unit as shown and described in U.S. Pat. No. 7,347,495 titled "Chair Back with Lumbar and Pelvic Supports," the contents of which are incorporated by reference herein. In short, the lumbar support 62 includes a support arm 63 and a lumbar pad 65 attached to the support arm 63. The lumbar pad 65 faces the lower back of a user when seated in the chair 10. The lumbar pad may include a series of concentric, flexible support rings 67 for supporting the lumbar region of the user's lower back. In the embodiment shown in FIGS. 5 and 6C, the support arm 63 projects through the upright support posts 18 to the exterior of the chair and away from the fabric 42 for access by a user. The lumbar pad 65 projects inwardly from the support posts 18 toward the fabric 42 in a direction opposite the support arm 63. The lumbar pad 65 is positioned in the space between the back support structure 12 (including the upright support posts 18 and support arms 21) and the tensioned fabric 42 and in abutting relation against the back face of the fabric 42.

The peripheral edges 23 of the support arms 21 are attached to the fabric cover 42, which may be attached in tension over the front surface 49 of the support arms 21. The tension of the fabric 42 may cause some curvature in the support arms 21, but as shown the arms may be pre-curved as predetermined to be shaped to the contours of a user's back. In one embodiment, the peripheral edges 23 of each support arm 21 are connected to the fabric 42 through a peripheral frame 27 attached to the fabric.

Figure 6A:
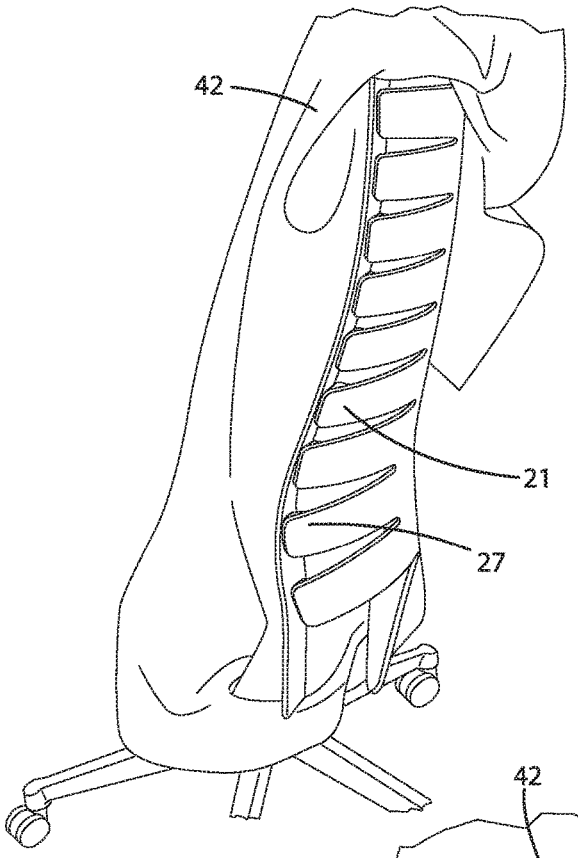
FIG. 6A is a side view of a portion of an office chair with portions of the fabric cover removed.
Figure 6B:
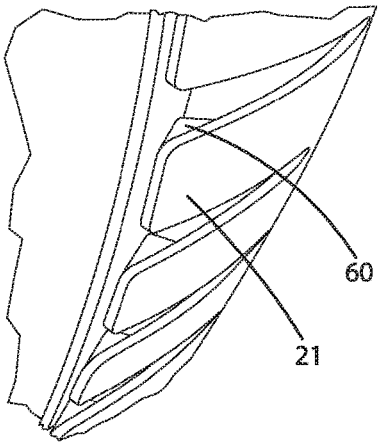
FIG. 6B is a close up view thereof.
Figure 6C:
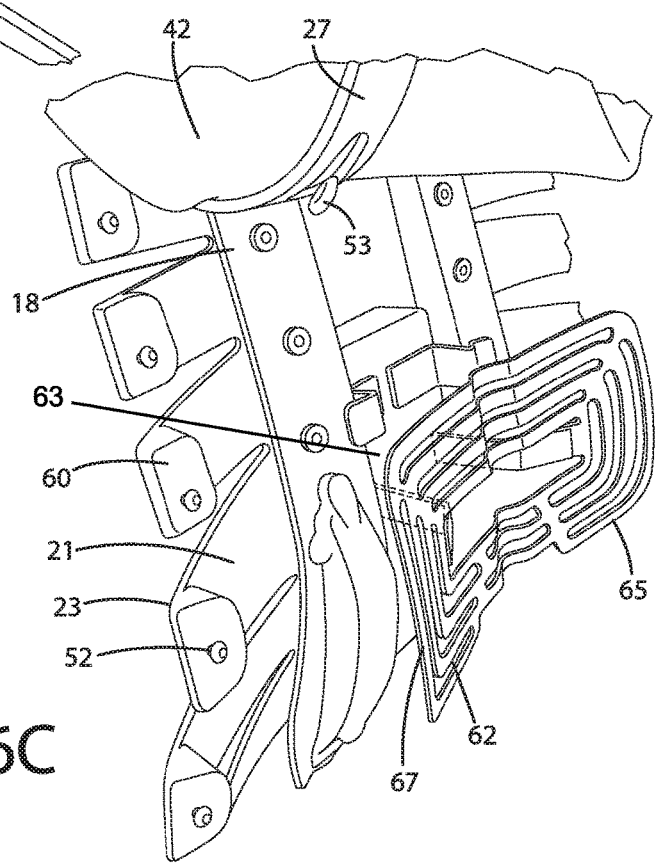
FIG. 6C is a front close up view thereof.
Figure 7:
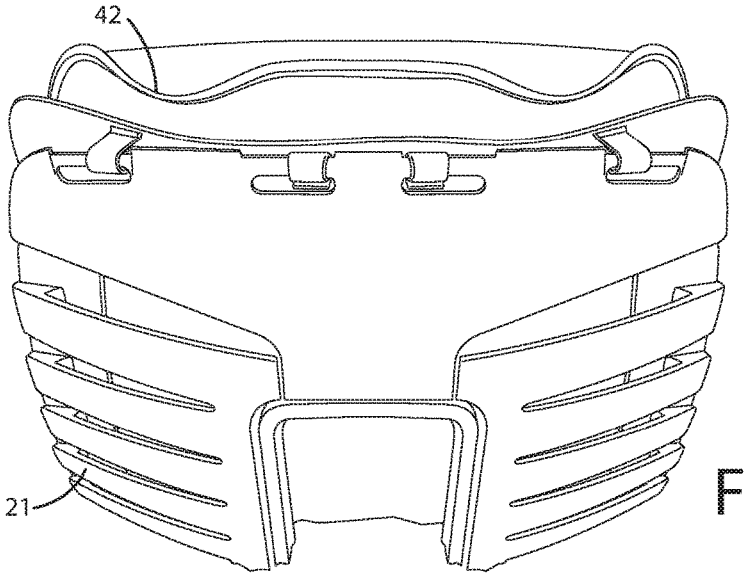
FIG. 7 is a rear view of the support arms according to one embodiment.
Figure 8A:
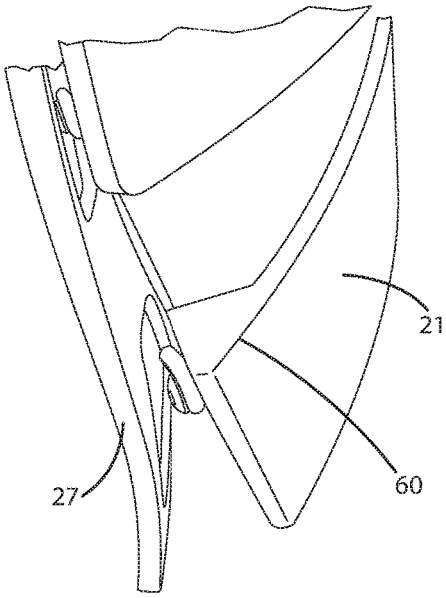
FIG. 8A is a side close up view of the support arms connected to the fabric cover.
Figure 8B:
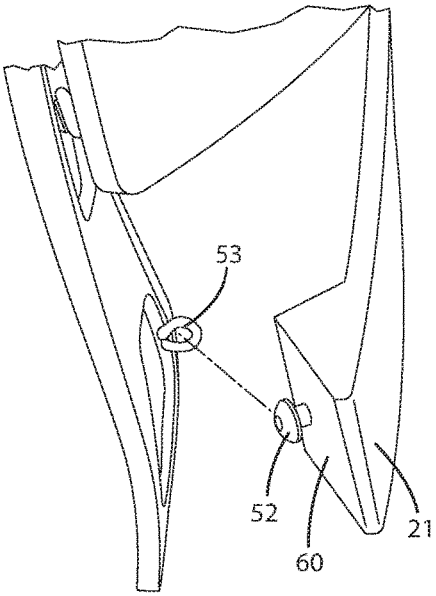
FIG. 8B is a side view with a support arm unattached to the cover.

The peripheral edges 23 of the support arms 21 may be attached to the fabric in numerous ways. FIGS. 6-11 show more detail with respect to one embodiment of the attachment of the fabric cover 42 to the support arms 21 via the peripheral frame 27. As shown, the peripheral frame 27 may be a strip of generally flexible plastic, which may be attached to the fabric, for example, by sewing the peripheral frame 27 to the fabric 42. As illustrated, the peripheral frame extends around the entire perimeter of the fabric cover 42. As shown in FIG. 6C, the peripheral strip 27 may include integral fasteners 53 for attaching to fasteners 52 on the peripheral edges 23 of the support arms 21. In the illustrated embodiment, the fasteners 53 on the strip/peripheral frame 27 are loops of material attached to the peripheral frame 27, and the fasteners 52 on the support arms 21 are protrusions, such as prongs or screw heads, extending from the support arms 21 for extending through the looped fasteners 53. This attachment method provides a degree of flexibility between the support arms 21 and the strip 27 to provide further independent movement and flexing of each individual support arm with respect to the strip 27 and the fabric 42. Also in this embodiment, the support arms 21 may include angle blocks 60 attached to the peripheral edges 23 of the support arms 21, and the fasteners 52 on the support arms may extend from the angle blocks 60. The angle blocks 60 create a "recurve" effect for the curved support arms 21 by angling the ends 23 of the support arms 21 and the fasteners 52 in a direction generally the opposite of the direction of the curve. The surface 23 from which the fasteners 52 extend is thus oriented at an angle from the longitudinal extent of the support arm 21. The recurve at the ends of the support arms 21 helps to orient the fabric with respect to a user's back to provide a flat surface for the user to rest against, and also adds some pretension to the suspended fabric material 42. The amount of recurve in the support arms can be adjusted to control the tension in the fabric 42.

Figure 9:
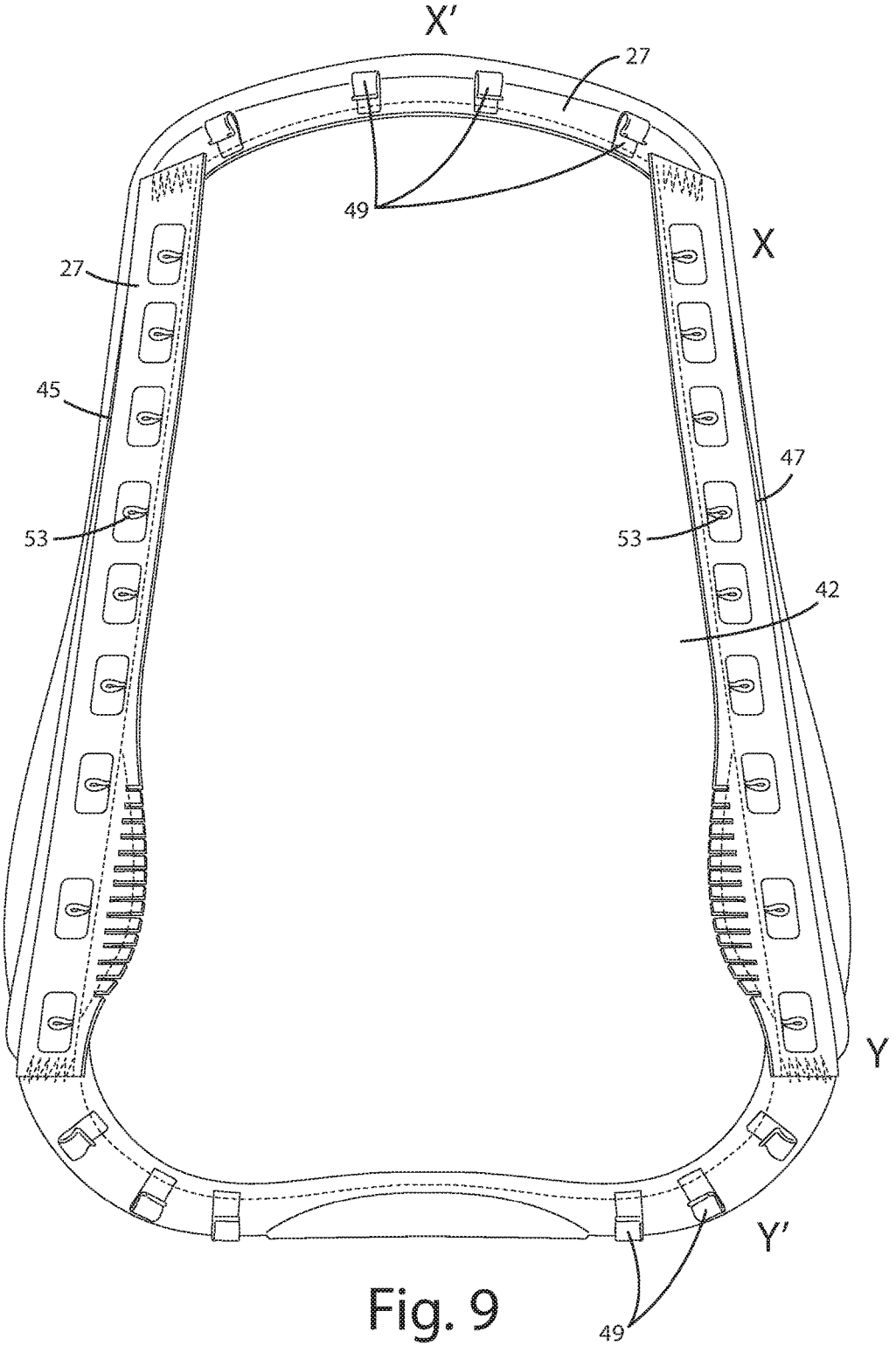
FIG. 9 is a rear view of a fabric cover according to one embodiment.
Figure 10:
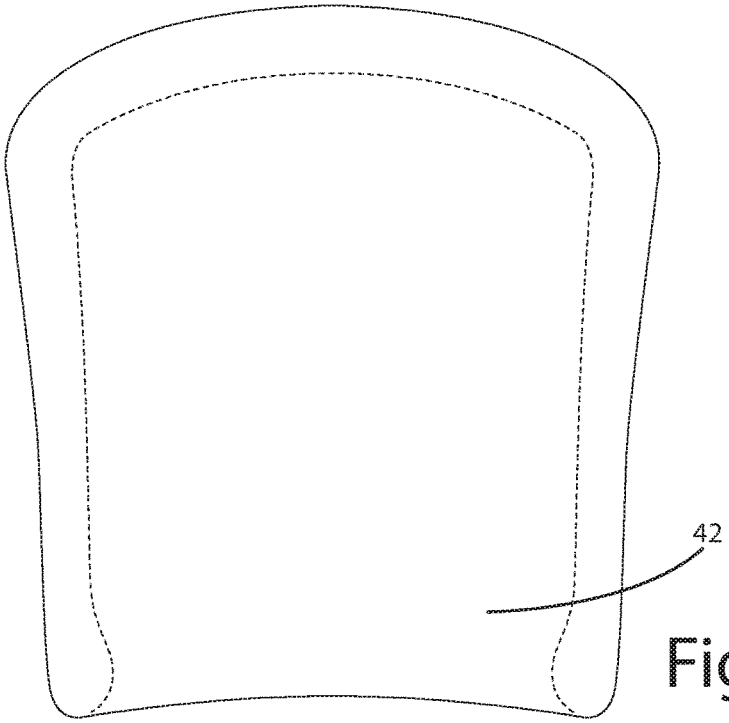
FIG. 10 is a front view of a back support portion of an office chair.
Figure 11:
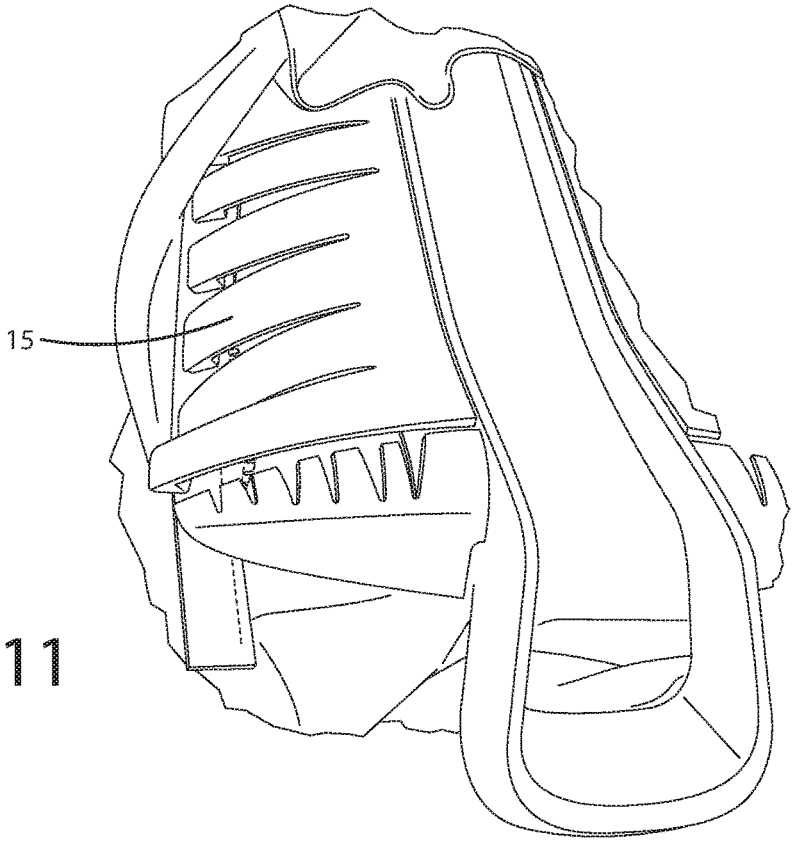
FIG. 11 is a rear view of a back support portion with portions of the fabric removed.

FIG. 9 shows an embodiment (regions X and Y) wherein the peripheral strip is widened and attached to the fabric, for example, by stitching the strip 27 to the fabric 42 inward from the peripheral edges 23 of the support arms 21. This structure may add increased tension in the lumbar region, creating additional support for the user in the lumbar region 39.

FIG. 9 also shows portions of the fabric cover 42 that attach to the support arms 21 in an alternative manner (regions X' and Y'). Referring to regions X' and Y' of FIG. 9, a plurality of spaced apart J-shaped clips 49 are attached to the fabric cover 42, for example, by sewing them to the fabric cover 42. The J-shaped clips 49 may hook onto the peripheral edges 23 or side edges of the support arms 21 to attach these portions of the fabric cover 42 to the support arms 21. In the illustrated embodiment, the J-shaped clips are spaced apart across the upper edge of the fabric cover 42, and across the opposing lower corners of the fabric cover on either side of the support arms 18. In another embodiment, the J-shaped clips may also be utilized in other locations.

Figure 12:
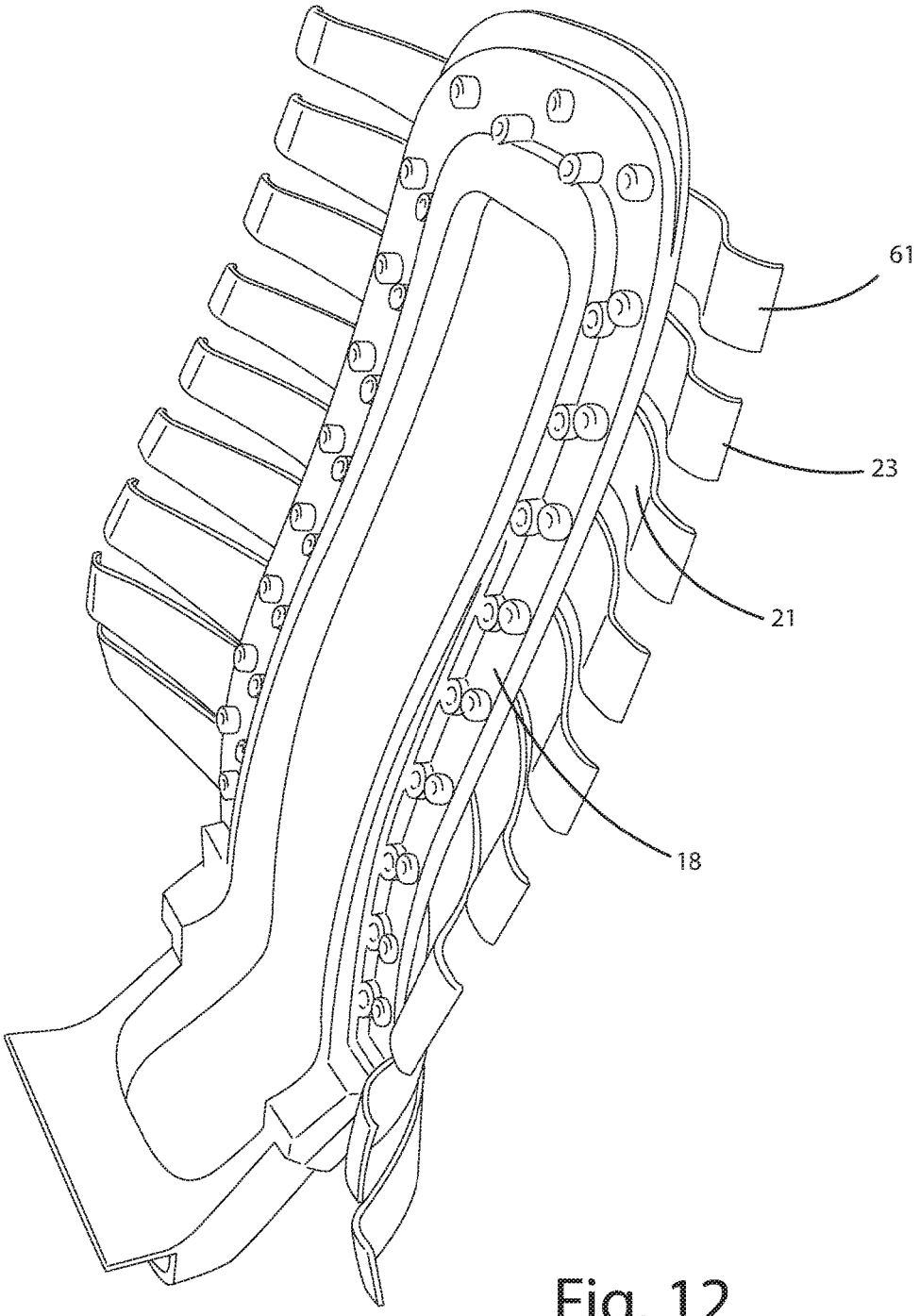
FIG. 12 is a front perspective view of a frame and support arms in accordance with another embodiment.

FIG. 12 shows an alternative embodiment for providing a recurve to the support arms, wherein the peripheral ends 23 include a curved portion 61 that is formed to curve in a direction generally the opposite of the curve of the support arms 21. As noted above, the recurve at the ends of the support arms 21 helps to orient the fabric with respect to a user's back to provide a flat surface for the user to rest against, and also adds some pretension to the suspended fabric material 42. The amount of recurve in the support arms can be adjusted to control the tension in the fabric 42.

Figure 13A:
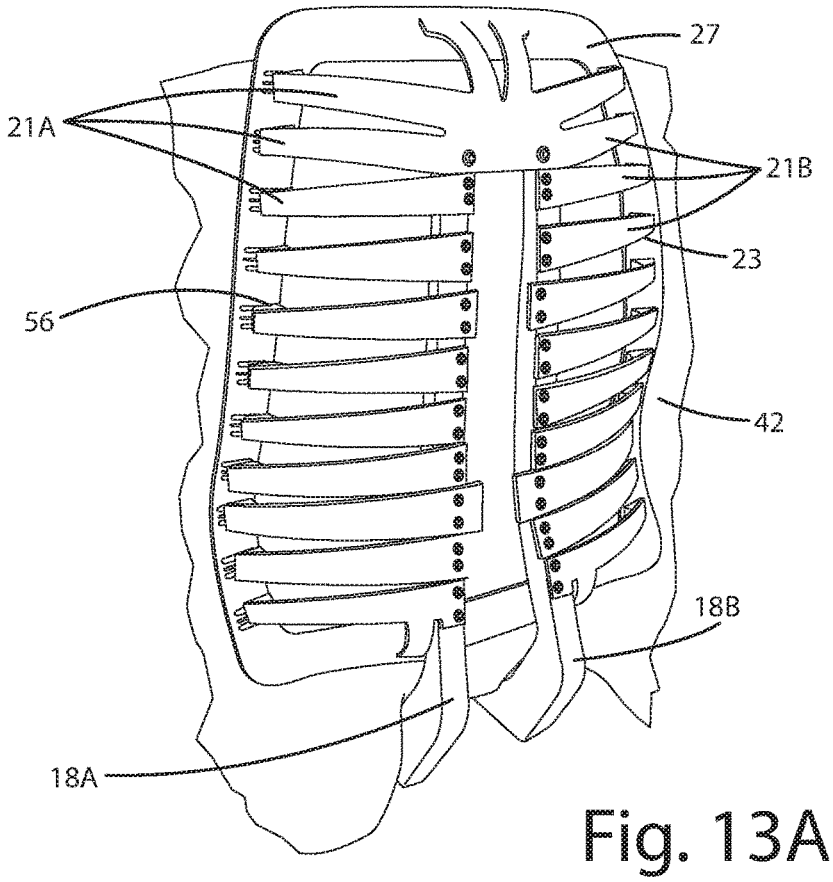
FIG. 13A is a rear view of a back support portion according to another embodiment with portions of the fabric removed.
Figure 13B:
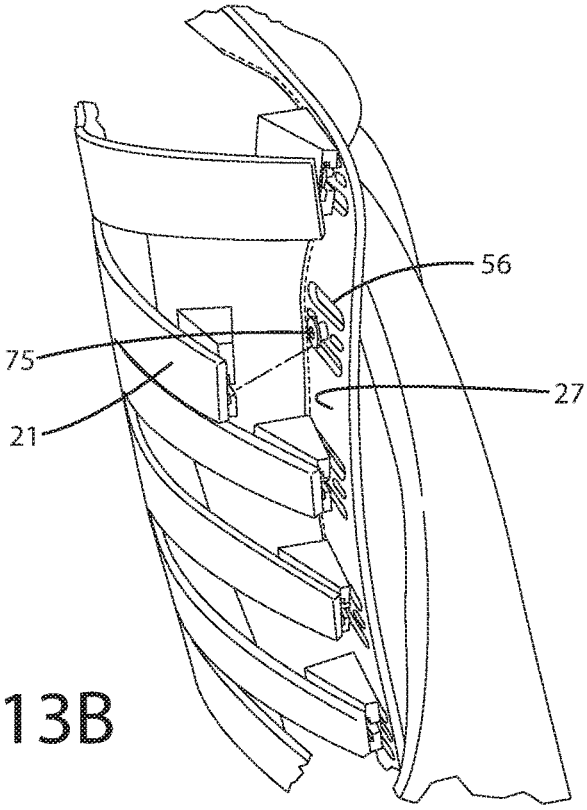
FIG. 13B is a perspective view of a portion of the back support portion thereof.
Figure 15:
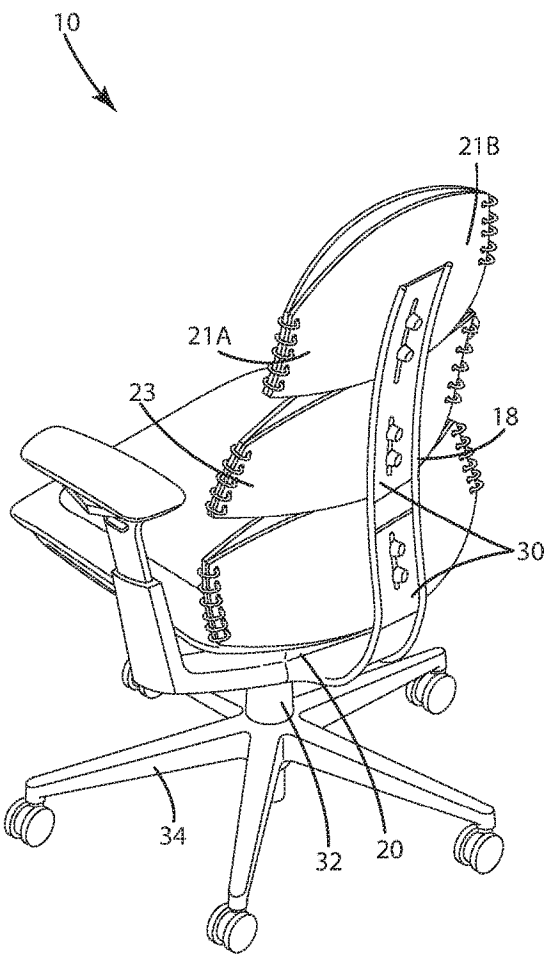
FIG. 15 is a rear perspective view thereof.
Figure 14:
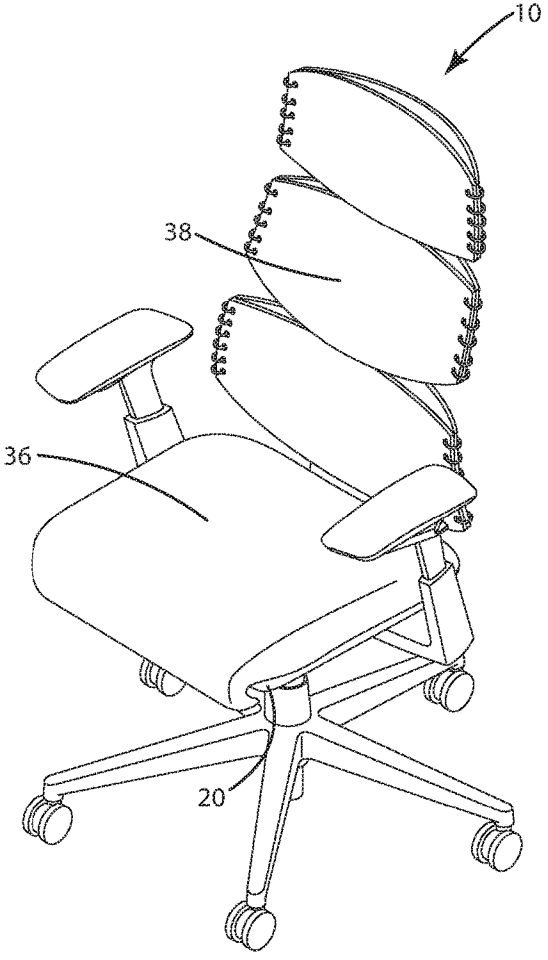
FIG. 14 is a front perspective view of an office chair according to another embodiment with the fabric cover removed.
Figure 17:
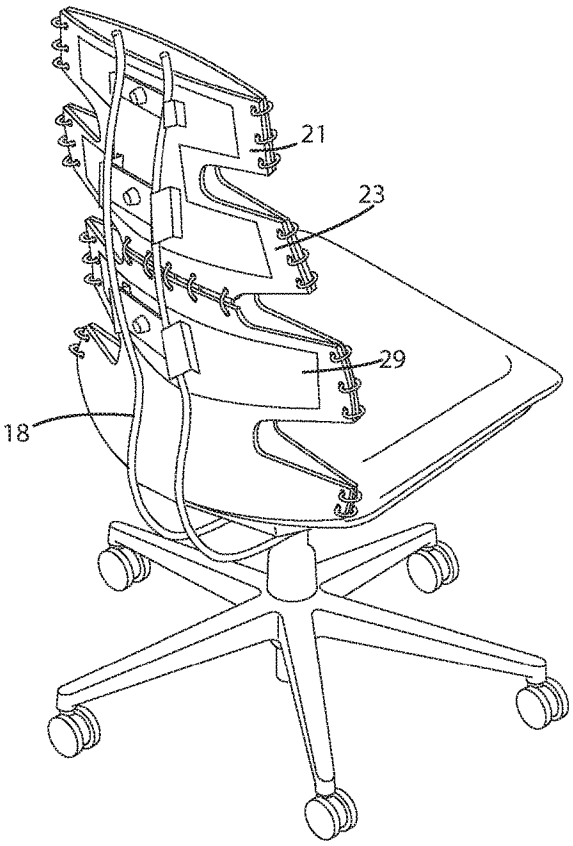
FIG. 17 is a rear perspective view thereof.
Figure 16:
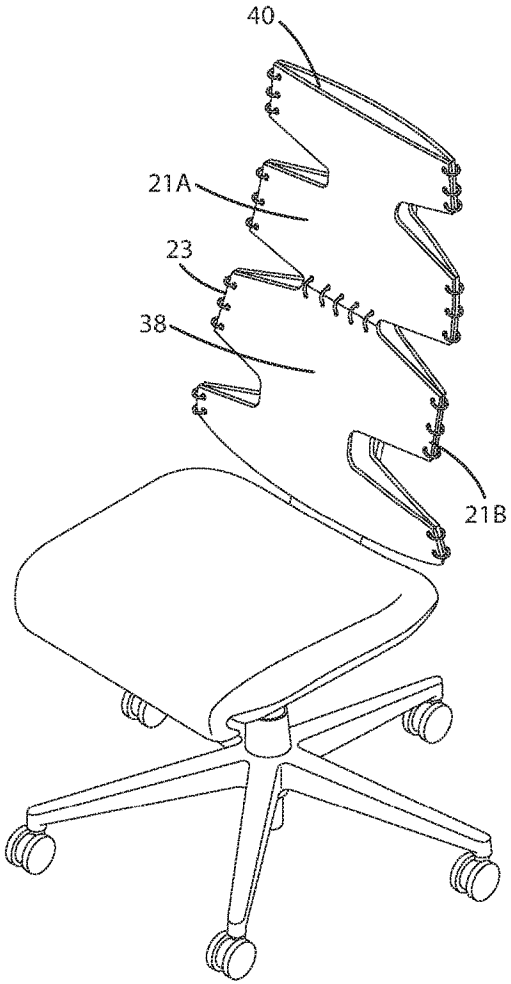
FIG. 16 is a front perspective view of an office chair with an alternative seat support portion.

FIGS. 13A and 13B show an alternative embodiment wherein the support arms 21 are attached to the support posts 18 with fasteners 71. As shown in FIGS. 13A and 13B, the peripheral frame 27 includes cutouts 56 disposed therein, such that the peripheral edges 23 of the support arms 21 can be attached to the fabric 42 in the locations of the cutouts 56. Referring to FIG. 13B, the peripheral strip 27 may include integral fasteners 73 for attaching to fasteners 75 on the peripheral edges 23 of the support arms 21. In an alternative to the above described embodiment, in this embodiment the fasteners 73 on the strip/peripheral frame 27 are protrusions attached to the peripheral frame 27, and the fasteners 75 on the support arms 21 are loops of material extending from the support arms 21. Similar to the above noted embodiment, this attachment method provides a degree of flexibility between the support arms 21 and the strip 27 to provide further independent movement and flexing of each individual support arm with respect to the strip 27 and the fabric 42. Also in this embodiment, the support arms 21 may include angle blocks 60 attached to the peripheral edges 23 of the support arms 21, and the looped fasteners 75 on the support arms may extend from the angle blocks 60.

FIGS. 14-18 show an alternative embodiment. In this embodiment, the upright support posts 18 are connected to each other by a series of webs 30. The embodiment shown in FIGS. 14-15 includes three sets of support arms 21, with three support arms 21*a* extending in one direction from the support posts 18 and three support arms 21*b* aligned with the support arms 21*a* and extending in the opposite direction. The peripheral edges 23 of each corresponding pair of support arms 21*a*, 21*b* are joined by a cross member 38. As illustrated, the cross members are connected in tension between the peripheral edges of the support arms 23 to create curvature in the support arms 23. The support arms 21 may get progressively shorter approaching the upper edge 40 of the chair 10, and the support arms 21, cross members 38, and support posts 18 may be covered with a fabric cover 42.

In this embodiment, a degree of adjustability is also provided to the back support 12. As illustrated, a pair of slides 29 are positioned behind each aligned set of support arms 21*a*, 21*b* and can be adjusted laterally (toward the upright posts 18 or the lateral edges 23 to provide control over the amount of flexibility in the support arms 21.

Figure 18:
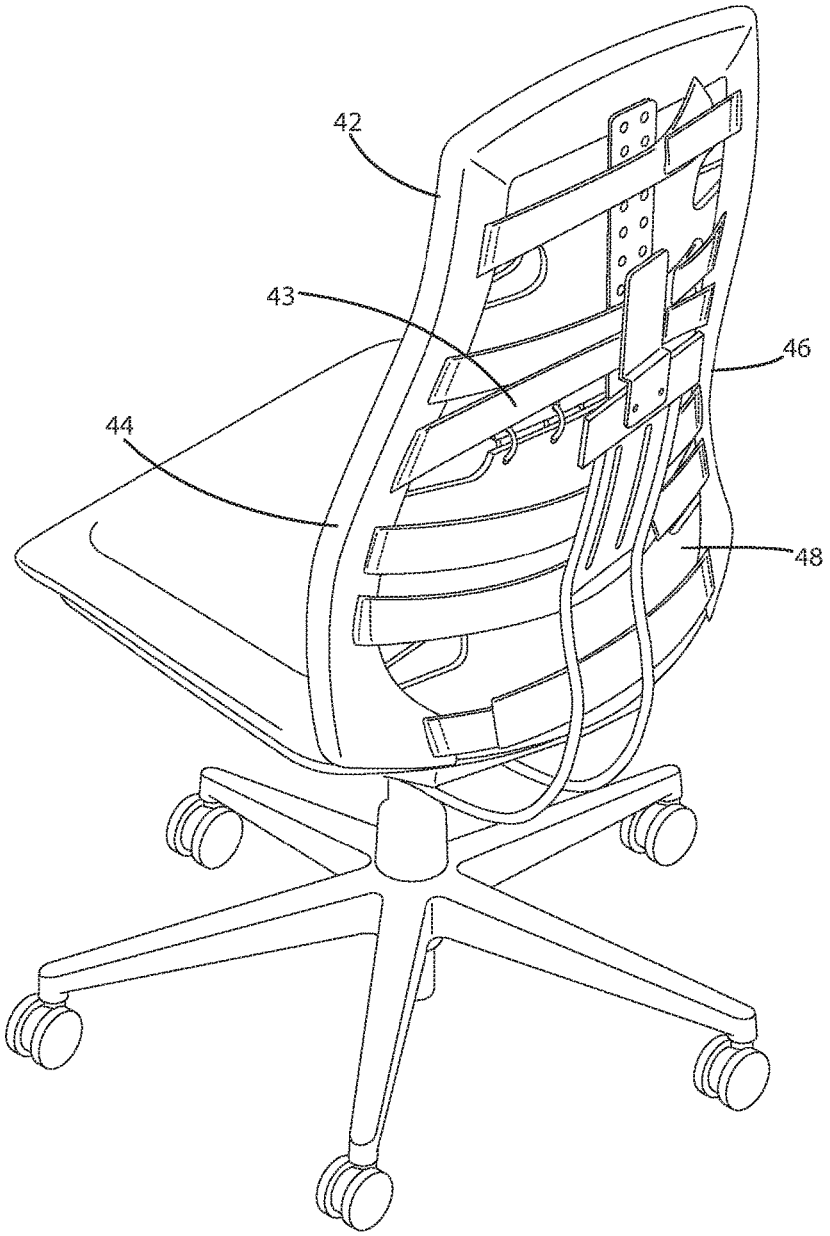
FIG. 18 is a rear perspective view thereof with a fabric cover included.

FIG. 18 shows the embodiment of FIGS. 14-18 with a fabric cover 42 attached over the support arms 21 and the cross members 38. The cover 42 is attached via a series of straps 43 that extend between a first edge 44 of the cover 42 and a second edge 46 of the cover 42 across a rear surface 48 of the support arms 21. The straps 43 may be tightened to hold the fabric cover in tension as it extends between the peripheral edges 23 of the support arms 21.

Figure 19B:
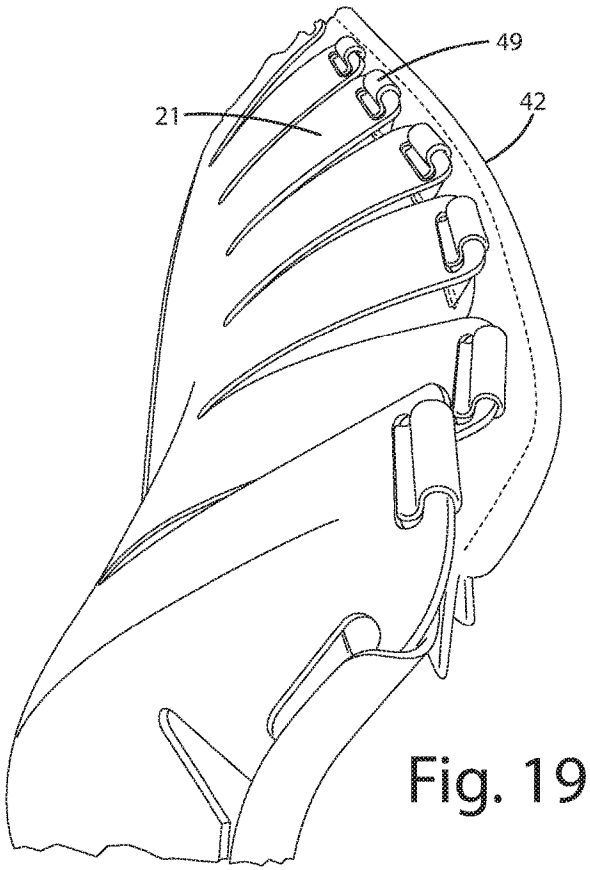
FIG. 19B is a close up view thereof with portions of the fabric unattached.
Figure 19A:
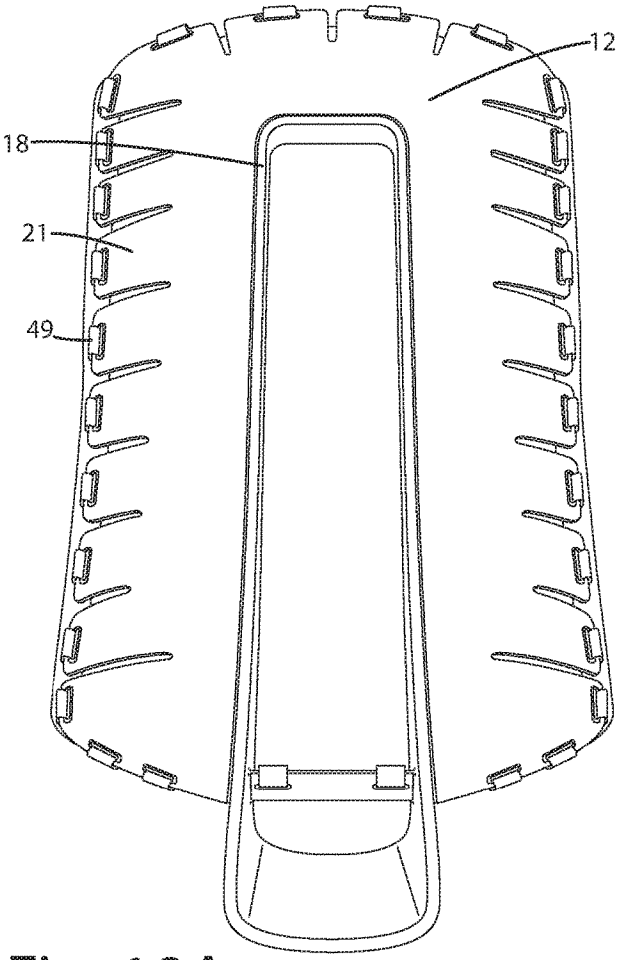
FIG. 19A is a rear view of a seat support portion according to another embodiment.

FIGS. 19A and 19B show another version of the back support 12. In this embodiment, the support arms 21 are formed by notches 80 extending into the peripheral edge 82 of the back support 12. The notches 80 extend only partially from the peripheral edge 82 to the support posts 18, thus reducing the degree of flexibility of the support arms 21. Also in this embodiment, the J-shaped clips 49 extend about the entire periphery of the fabric cover 42 and are the sole method for attaching the fabric cover 42 to the back support 12.

Figure 20:
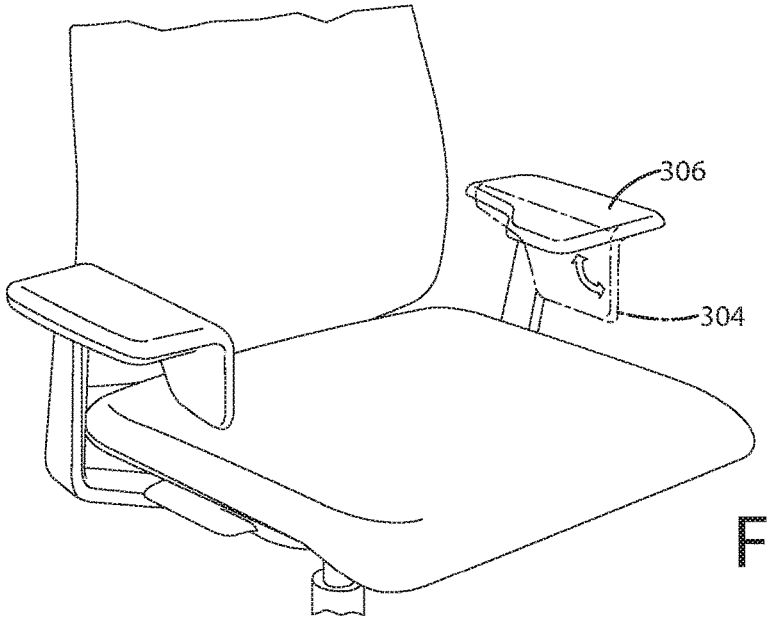
FIG. 20 is a front perspective view of a portion of an office chair according to another embodiment.
Figure 21:
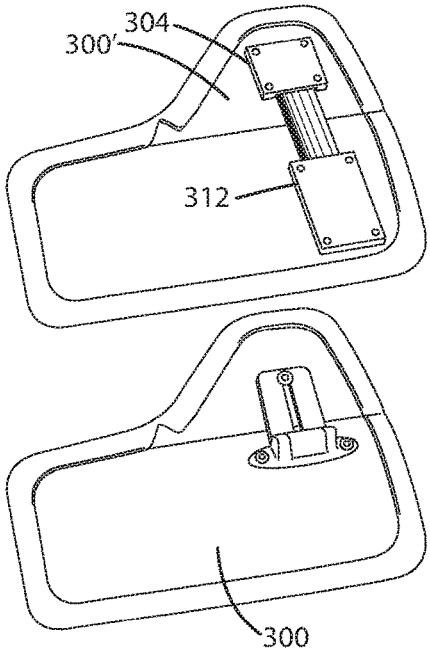
FIG. 21 is a bottom view of two alternative versions of a tablet armrest in an open position.
Figure 22:
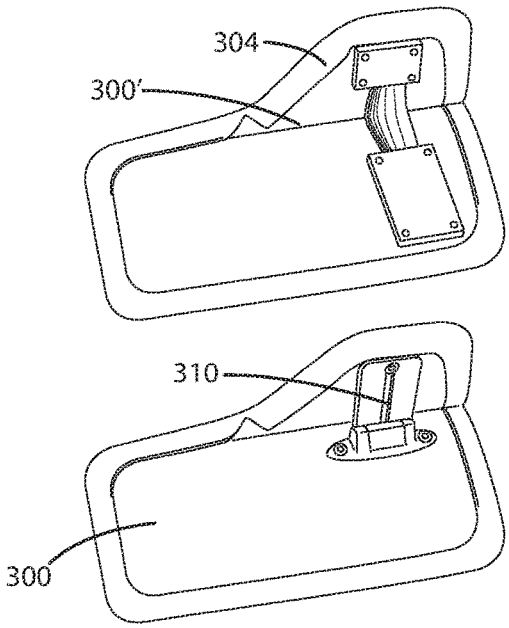
FIG. 22 is a bottom view of two alternative versions of a tablet armrest in a closed position.

An additional office chair embodiment is shown in FIGS. 20-22. In this embodiment, the office chair 10 includes a work surface 300 for supporting a device, such as a tablet computer 302. As shown, a portion 304 of the work surface 300 is capable of folding downwardly with respect to another portion 306 of the work surface. FIGS. 21 and 22 show the bottom surface of two different designs for the work surface 300, 300'. FIG. 21 shows both of the designs in a flat position. FIG. 22 shows both designs in a folded down position. The design 300 shows a hinge 310 with a movable portion for locking the work surface 300 in the flat position. The design 300' shows a flexible member 312 that may be flexed between the flat and folded positions.

Figure 23:
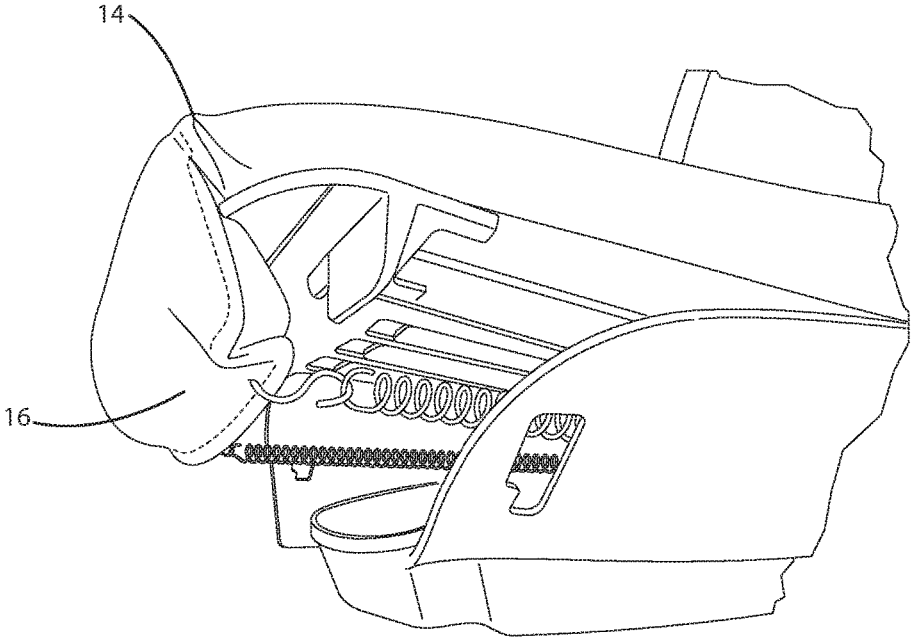
FIG. 23 is a side view of one embodiment of an office chair with a repositionable front edge.
Figure 24:
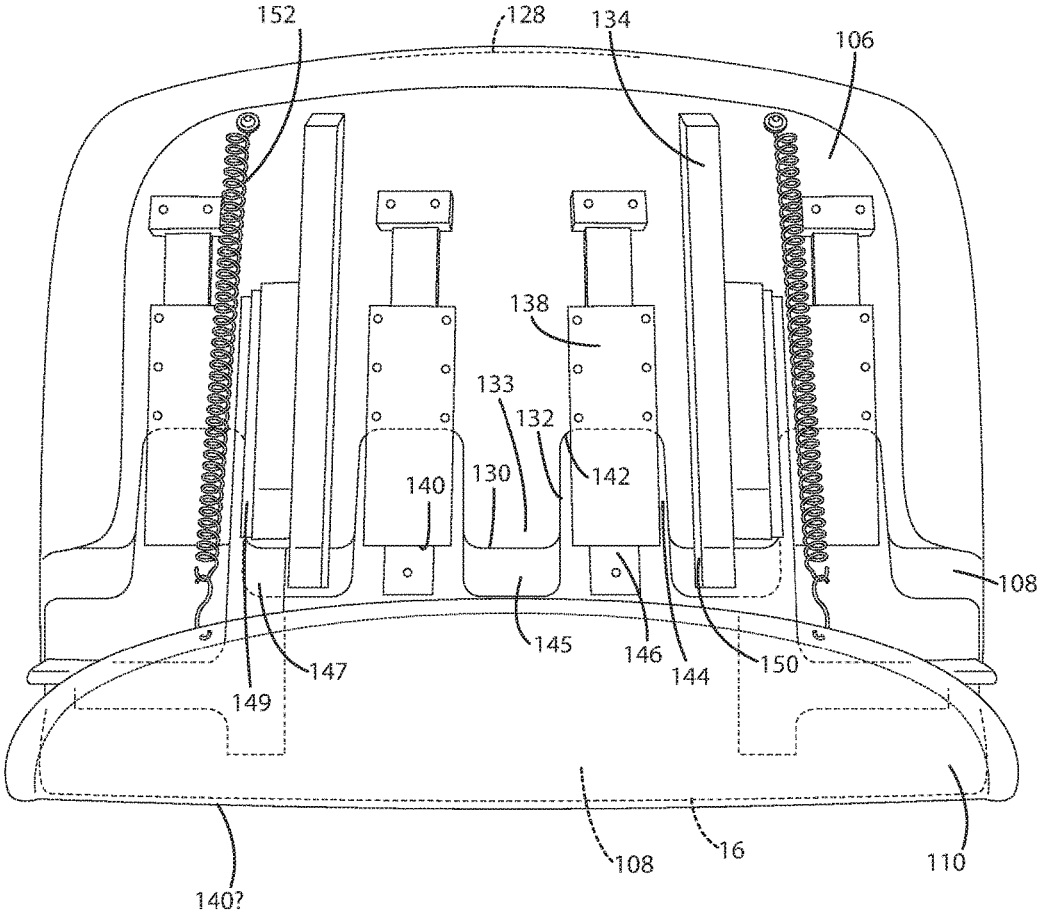
FIG. 24 is a bottom view of a seat support.
Figure 25:
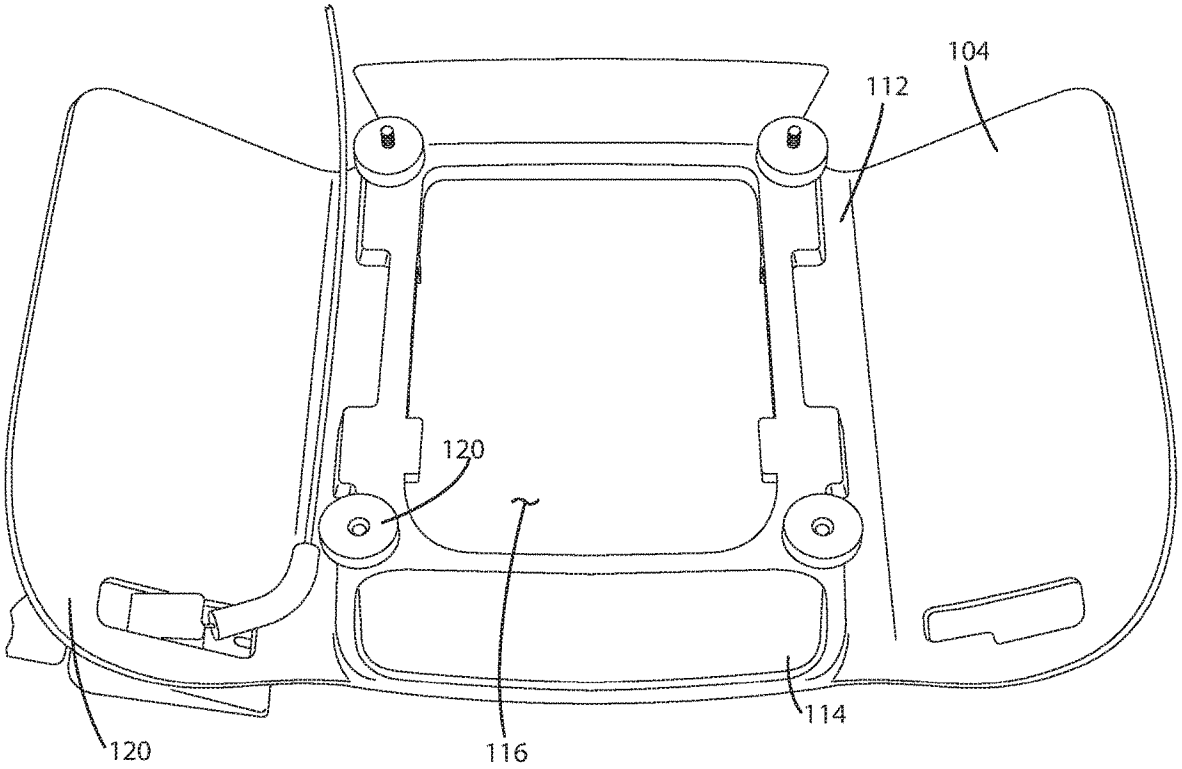
FIG. 25 is a top view of a seat support base.

FIGS. 23-27 show embodiments for repositioning the front edge 100 of a chair 10. The chair 10, or any office chair, may include a seat support 14 mounted on a chair frame 20 for supporting the weight of a user. The chair 10 includes a back support 12 positioned adjacent to the rear edge 15 of the seat support 15. The seat support 15 thus defines a length between the rear edge 15 and the front edge 16. This distance may not be suited for every user. For example, a taller user may find this distance to be too short, such that the taller user does not have sufficient support underneath the thighs. A shorter user may find this distance to be too great. The shorter user may find that the front edge 16 extends too far underneath the user's thighs and encroaches on the rear of the user's knee and calf. The embodiments disclosed in FIGS. 23-25 provide a seat support 14 with a front edge 16 that may be repositionable by the user to optimize the comfort and support level for each individual user.

FIGS. 23-25 show a first such embodiment. In this embodiment, the seat support 14 includes a fixed base 104, a rear seat portion 106, a front seat portion 108 and a cover 110. The base 104 is supported on the chair frame 20, and is fixed with respect to the chair frame. As shown in FIG. 25, the base 104 includes an upper surface 112 that includes mounting structure for the rear seat portion 106. The lower surface of the base 104 may attach to a conventional chair frame 120. In the embodiment shown in FIGS. 23-25, the base 104 includes a central ring shaped structure 114 that defines a central opening 116. Four resilient bosses 120 are spaced about the central opening 116 for attachment to the rear seat portion 106. In addition, a pair of wings 122 extend from opposing sides of the central structure 114. The wings 122 may curve slightly upwardly to contact, or extend adjacent to, the front and rear seat portions 106, 108.

The front 108 and rear 106 seat portions are mounted above the fixed base 104. As shown in FIG. 24 the rear seat portion 106 includes an upper surface 124 facing the user when attached to a chair frame 20, and a lower surface 126 for attaching to the base 104. In one embodiment, the lower surface 126 includes a rear edge 128 for positioning adjacent to a back support 12 and a front edge 130 opposite the rear edge 128. The front edge 130 defines at least one cutout 132 extending into the front edge 130. In the illustrated embodiment, four cutouts 132 are defined in the front edge 130. Three protrusions 133 of the same shape as the cutouts 132 are formed between the cutouts 132. A pair of mounting rails 134 are attached to the lower surface 126 between the cutouts 132, such that the mounting rails extend to the front edge 130. The mounting rails 134 include fastener holes 136 for receiving fasteners extending from the bosses 120 on the base 104 to attach the rear seat portion 106 to the base 104 with the rear seat portion 106 fixed with respect to the base 104. In one embodiment, the rails 134 are made from a generally rigid material. Slide plates 138 are mounted to the lower surface 106 to extend underneath each one of the cutouts 132. The slide plates 138 may each define a track 140 extending through the slide plate 138.

The front seat portion 108 is attached to the rear seat portion 106 in a manner whereby the front portion 108 can move with respect to the rear portion 106. As shown in FIG. 35, the front portion may be made from a resilient plastic material, and may include a front edge 140 that forms the front edge 16 of the chair 10 and a rear edge 142 opposite the front edge 16. As shown, the rear edge 142 includes a series of four protrusions 144 having the same shape as the cutouts 132 on the rear seat portion 106. A series of three cutouts 145 are formed between the protrusions 144, such that the rear edge 142 of the front seat portion 108 can interfit with the front edge 130 of the rear seat portion 106 with the protrusions 144 of the front seat portion 108 extending into the cutouts 132 on the rear seat portion 106 and the protrusions 133 of the rear seat portion 106 can fit within the cutouts 145 on the front seat portion 108. The depth of the cutouts 132, 144 and the respective lengths of the protrusions 133, 145 define the distance of travel for the front seat portion 108 with respect to the rear seat portion 106. In the illustrated embodiment, the front seat portion 108 includes guide blocks 146 shaped to extend into the tracks 140 within the slide plates 138. The tracks 140 may enclose, or partially enclose, the guide blocks to enable sliding travel of the guide blocks 146 within the tracks 140. In addition, the front seat portion 108 may include rails 148 that are mounted to the front seat portion 108 and extend from the rear edge 142 adjacent to the mounting rails 134 of the rear seat portion 106. The rails 148 and mounting rails 134 may each include structure on their adjacent faces for interfitting with each other. For example, one of the rails 148 and mounting rails 134 may include a channel 150 and the other of the rails 148 and mounting rails 134 may include a roller or bearing 149 that extends into the channel 150 to facilitate travel of the front seat portion 108 with respect to the rear seat portion 106. In addition, one or more assist springs 147, such as leaf springs, may be attached to the front seat portion 108, enabling the front seat portion 108 to be bent downwardly or curl downwardly, but biasing the front seat portion 108 to return to the generally planar position shown in FIG. 24.

As shown in FIG. 24, the cover 110 may extend over the front and rear seat portions 106, 108. In one embodiment, the cover 110 is fixedly attached to the rear edge 128 of the rear seat portion 106 and to the front edge 16 of the front seat portion 108. A pair of springs 152 attach between the rear seat portion 106 and the cover 110 at the front edge 16. The springs act to bias the front seat portion 108 rearwardly in an position in which the front and rear seat portions are interfitted with each other. In this position, the cover 110 and front edge 16 of the front seat portion 108 are wrapped downwardly to curl underneath the front seat portion 108. A pair of paddles 154 mounted to the front seat portion 108 may be grasped by the user to pull the front edge 16 and uncurl the front seat portion 108 against the force of the springs 152 and with the assistance of the assist springs 147. The uncurling of the front seat portion 108 extends the effective length of the seat support 14. Conventional locking means may be provided to enable a user to lock the front edge 16 in any desired position, or in one of a plurality of discrete positions.

Figure 26A:
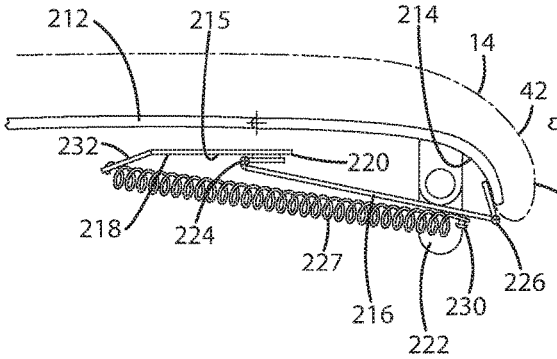
FIG. 26A is a side view of another embodiment of a seat support with a repositionable front edge in a retracted position.
Figure 26B:
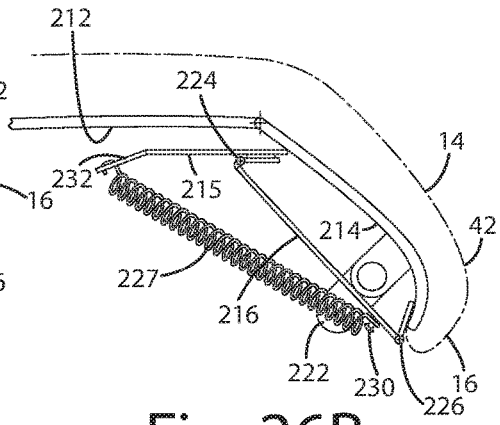
FIG. 26B is a side view thereof with the front edge in a partially extended position.

FIGS. 26A and 26B show a second embodiment of a repositionable front edge 16 for a chair 10. Similar to the previous embodiment, in this embodiment, the chair 10 includes a seat support 14 having a movable portion (including the front edge 16) and a fixed portion. FIGS. 26A and 26B show one embodiment of the fixed portion, which includes a fixed base 204 similar to the fixed base 104 of the previous embodiment. The fixed base 204 includes a central structure 206 defining a central opening 208. As in the previous embodiment, a pair of wings 210 extend from opposing sides of the central structure 206. Unlike the previous embodiment, in this embodiment, the rear seat portion 212 is fixedly attached to the wings 210, although it could be mounted in other locations.

Figure 27:
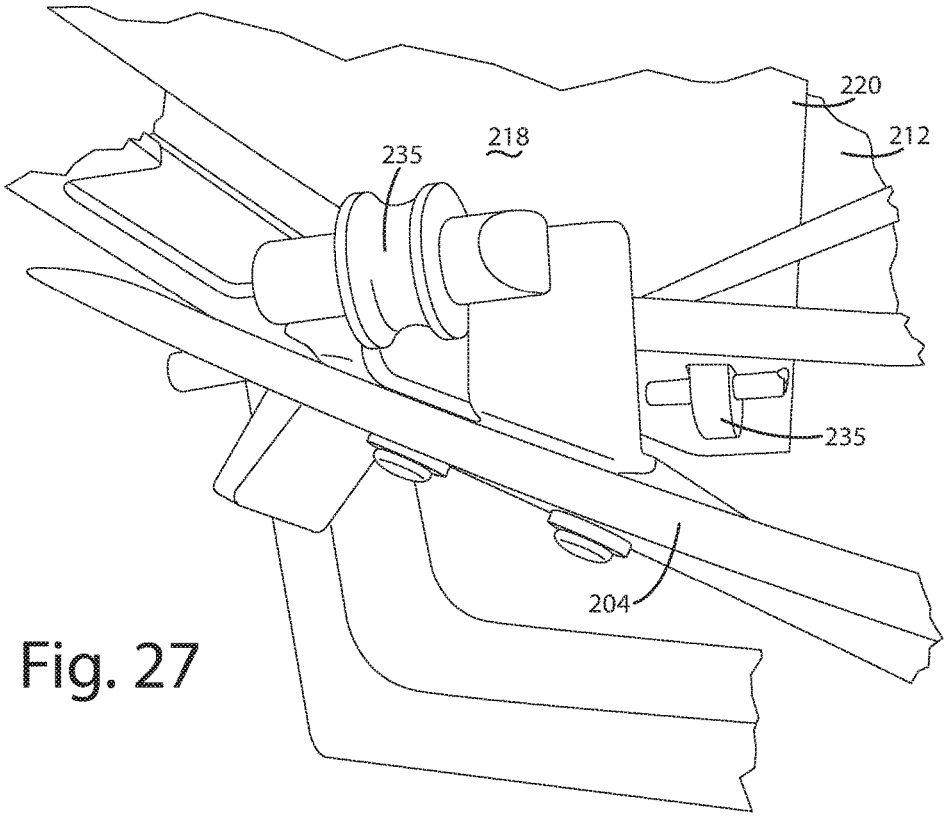
FIG. 27 is a bottom perspective view of a portion of a repositionable front edge mechanism.

As shown in FIGS. 26A and 26B, the seat front portion 214 includes a generally horizontal plate 215 and an angled plate 216 hingedly attached to both the plate 215 and the front edge 16 of the seat 14, in particular, the angled plate is hingedly attached to the fabric cover 42 at the front edge 16 of the seat 14. Referring to FIG. 27, the horizontal plate 215 includes a pair of side rails 218 connected by a cross piece 220 positioned near the front edge 16. The side rails 218 extend rearwardly underneath the rear seat portion 212, within the opening created between the base 204 and the rear seat portion 212.

The cross piece 220 is generally rigid and includes at least one paddle 222 extending outwardly therefrom for grasping by a user. One end of the angled plate 216 is mounted to the cross piece 220 by hinges 224, and the other end of the angled plate is attached to the cover 42 by hinges 226, such that the angled plate 216 can be pivoted between an extended position shown in FIG. 27, wherein the angled plate supports the cover 42 and front edge 16 of the seat 14 in a generally extended position, and an angled position shown in FIG. 26B, wherein the angled plate 216 pivots downwardly and the front edge 16 of the seat 14 is caused to curl downwardly underneath the seat rear portion 212. A spring 227 is mounted to a fastener 230 at front portion of the angled plate 216 and to a tab 232 extending from the cross piece 220. The spring 226 acts to bias the angled plate 216, and thus the front edge 16 of the chair in the angled position.

The side rails 218 of the horizontal plate 215 are supported on rollers 235 (shown in FIG. 27) mounted to the base 204. FIG. 27 shows the space between the base 204 and the seat 14 taken from a rear perspective. FIG. 27 shows the space between the base 204 and the seat 14 taken from a front perspective. The horizontal plate 215 is therefore capable of movement between a retracted position, wherein the horizontal plate 215 is positioned nearer to the back support, and an extended position, wherein the horizontal plate is positioned farther away from the back support. In one embodiment, the horizontal plate 215 and the angled plate 216 move together as the user pulls or retracts the paddle 222. For example, as the user pulls outwardly on the paddle 222 to extend the front edge 16, the horizontal plate 215 travels away from the back support on the rollers 235 while the angled plate 216 also pivots to the extended position to force the front edge 16 to uncurl and extend the front edge 16. As the user retracts the paddle 222, the horizontal plate 215 is forced to travel rearwardly on the rollers 235 as the angled plate 216 pivots to the retracted position. In one embodiment, a generally conventional locking mechanism is included to enable the user to lock the front edge 16 in a desired position.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The embodiments of the invention in which an exclusive property or privilege is claimed are defined as follows:

1. A back support for a chair comprising:

a chair frame;

a pair of upright support posts mounted to said chair frame;

a plurality of flexible support arms extending laterally outwardly from said upright support posts, said support arms each including a peripheral edge, said support arms including a first set of support arms extending in a first lateral direction from said upright posts and a second set of support arms extending in a second direction from said upright posts;

a material extending in tension between said peripheral edges of said first set of support arms and said peripheral edges of said second set of support arms such that at least a central portion of said material is spaced from said support arms; and a lumbar support mechanism mounted between said upright support posts, said lumbar support mechanism including a support arm and a lumbar pad connected to said support arm, said lumbar pad extending from said support arm through said upright support posts and into an abutting relation against the back face of the material.

2. The back support of claim 1 wherein said upright posts are molded integrally from a first material.

3. The back support of claim 1 wherein said support arms are molded integrally from a second material.

4. The back support of claim 1 including a first connector on said material and a second connector on one of said support arms, said first connector fixedly connected to said second connector.

5. A back support for a chair comprising:

a chair frame;

a pair of upright support posts mounted to said chair frame;

a plurality of flexible support arms extending laterally outwardly from said upright support posts, said support arms each including a peripheral edge, said support arms including a first set of support arms extending in a first lateral direction from said upright posts and a second set of support arms extending in a second direction from said upright posts; and a material extending in tension between said peripheral edges of said first set of support arms and said peripheral edges of said second set of support arms such that at least a central portion of said material is spaced from said support arms, wherein a portion of each of said support arms is curved in a first direction, and wherein a second portion of each of said support arms is curved in a different direction to form a recurve portion.

6. The back support of claim 5 wherein said second portion includes said peripheral edges.

7. The back support of claim 6 wherein said one of said first and second connectors is a loop of flexible material.

8. A back support for a chair comprising:

a chair frame;

a pair of upright support posts mounted to said chair frame, said upright support posts;

a plurality of flexible support arms extending laterally outwardly from said upright support posts, said support arms each including a peripheral edge, said support arms including a first set of support arms extending in a first lateral direction from said upright posts and a second set of support arms extending in a second direction from said upright posts; and a material extending in tension between said peripheral edges of said first set of support arms and said peripheral edges of said second set of support arms such that at least a central portion of said material is spaced from said support arms, said material having a forward surface facing a back of a user and a rear surface opposite said forward surface;

the back support including a lumbar support mechanism having a first portion mounted between said upright support posts and a lumbar pad extending from said first portion to face said back of said user sitting in the chair and into an abutting relation against said rear surface of said material, said lumbar support mechanism being vertically adjustable by sliding said lumbar support mechanism up and down within said upright support posts.

9. The back support of claim 8 wherein said support arms and said upright support posts are formed integrally from the same material.

10. The back support of claim 8 wherein each of said peripheral edges includes an attachment portion having structure for attaching said support arm to said material.

11. The back support of claim 10 wherein said support arms are curved, said support arms having a convex shape to conform to a shape of a user's back.

12. The back support of claim 8 wherein said first portion of said lumbar support mechanism includes a support arm that projects through said upright support posts to a position beyond the support posts on the exterior of the chair.

* * * * *